US006098941A

United States Patent [19]

Gates et al.

[11] Patent Number: 6,098,941

[45] Date of Patent: Aug. 8, 2000

[54] MOUNTING APPARATUS FOR COMPONENTS/ASSEMBLIES

[75] Inventors: Frank Vernon Gates, Township of Roxbury, Morris County; Louis F. Haitmanek, Florham Park, both of N.J.

[73] Assignee: AT&T Corporation, New York, N.Y.

[21] Appl. No.: 09/221,866

[22] Filed: Dec. 29, 1998

[51] Int. Cl.[7] ..... A47B 96/01

[52] U.S. Cl. ..... 248/224.51; 248/225.11

[58] Field of Search ..... 248/222.13, 220.21, 248/220.22, 224.51, 225.11, 223.31, 475.1, 489, 675, 201, 221.11, 222.51, 222.52

[56] References Cited

U.S. PATENT DOCUMENTS

| | | | |
|---|---|---|---|
| 3,622,116 | 11/1971 | Fellows | 248/467 |
| 4,340,199 | 7/1982 | Brock | 248/544 |
| 4,701,586 | 10/1987 | Hagberg | 219/746 |
| 5,035,389 | 7/1991 | Wang | 248/224.51 |
| 5,226,625 | 7/1993 | Hanna | 248/222.13 |
| 5,356,105 | 10/1994 | Andrews | 248/221.11 |
| 5,425,524 | 6/1995 | Messina, Jr. | 248/475.1 |

*Primary Examiner*—Ramon O. Ramirez
*Assistant Examiner*—Gwendolyn Baxter
*Attorney, Agent, or Firm*—Morgan & Finnegan, LLP

[57] ABSTRACT

An apparatus for mounting a component having a housing, the housing including a backplate. The apparatus includes a pair of mounting tabs disposed on the backplate. Each mounting tab includes a support member attached to the baseplate and a flange member attached to the support member. The mounting tabs are arranged so that the flange members are disposed towards each other. The apparatus also includes a bracket including a baseplate defining a plane and a mounting pad disposed on the baseplate in the plane. The mounting pad includes an attachment area, attached to the baseplate, and a finger attached to the central area, the finger projecting in the plane and articulable in the plane. The mounting pad may be disposed in a region between the support members of the mounting pads and between the flange members of the mounting pads and the baseplate.

15 Claims, 10 Drawing Sheets

MOUNTING APPARATUS FOR COMPONENTS/ASSEMBLIES

FIELD OF THE INVENTION

The present invention relates to a mounting mechanism for a component/assembly enclosure.

BACKGROUND OF THE INVENTION

In the modern office environment, it is often necessary to mount electrical or electronic components or assemblies on vertical surfaces, such as walls. For ease of installation, it is desirable to use a mounting mechanism that depends only on gravity to hold the component or assembly in place. In the past, a keyhole/mounting peg arrangement was used. This prior art arrangement requires clearance around the ultimate position of the component or assembly, in order to install the component or assembly. In many locations, horizontal clearance is limited. A problem arises in that, in many locations, there is insufficient clearance to mount a component or assembly using prior art mounting schemes.

In addition, in order to engage the keyhole/mounting peg arrangement, the corresponding mounting components must be closely "aimed", a requirement often made difficult because the component being mounted blocks the view of the peg. This may cause the installation process to be more costly and time-consuming than is desirable.

SUMMARY OF THE INVENTION

The present invention solves the problem of mounting components or assemblies close to ceilings, walls and/or floors with the mounting mechanism depending only on gravity to hold it in place. A positive mechanical locking feature to prevent disassembly during vibration is also provided. The present invention allows components to be mounted in locations having limited clearance and does not require close aiming during the installation.

The present invention is an apparatus for mounting a component having a housing, the housing including a backplate. The apparatus includes a pair of mounting tabs disposed on the backplate. Each mounting tab includes a support member attached to the baseplate and a flange member attached to the support member. The mounting tabs are arranged so that the flange members are disposed towards each other. The apparatus also includes a bracket including a baseplate defining a plane and a mounting pad disposed on the baseplate in the plane. The mounting pad includes an attachment area, attached to the baseplate, and a finger attached to the central area, the finger projecting in the plane and articulable in the plane. The mounting pad may be disposed in a region between the support members of the mounting pads and between the flange members of the mounting pads and the baseplate.

In one aspect of the present invention, the mounting tabs are be arranged so as to form an included angle between inner surfaces of the support members of the mounting tabs. In another aspect of the present invention, the finger of the mounting pad is arranged so that a face of the finger abuts an inner surface of a support member. In another aspect of the present invention, the finger of the mounting pad includes a locking tab that engages with a support member of one mounting tab.

In one embodiment of the present invention, the mounting pad further includes another finger attached to the central area.

In another embodiment of the present invention, a plurality of pairs of mounting tabs are disposed on the backplate and a plurality of mounting pads are disposed on the baseplate. In one aspect of this embodiment, each finger of each mounting pad includes a locking tab that engages with a support member of a different mounting tab.

In another embodiment of the present invention, each mounting pad has one finger.

In another embodiment of the present invention, there are two pairs of mounting tabs, a first pair and a second pair, disposed on the backplate and two mounting pads, a first mounting pad and a second mounting pad, disposed on the baseplate. The first pair of mounting tabs is disposed approximately 180 degrees from the second pair of mounting tabs, and the first mounting pad is disposed approximately 180 degrees from the second mounting pad.

In one embodiment, the mounting pads are plastic. In another embodiment, the mounting pads are metal.

BRIEF DESCRIPTION OF THE DRAWINGS

The details of the present invention, both as to its structure and operation, can best be understood by referring to the accompanying drawings, in which like reference numbers designations refer to like elements.

DETAILED DESCRIPTION OF THE INVENTION

Figure 1:
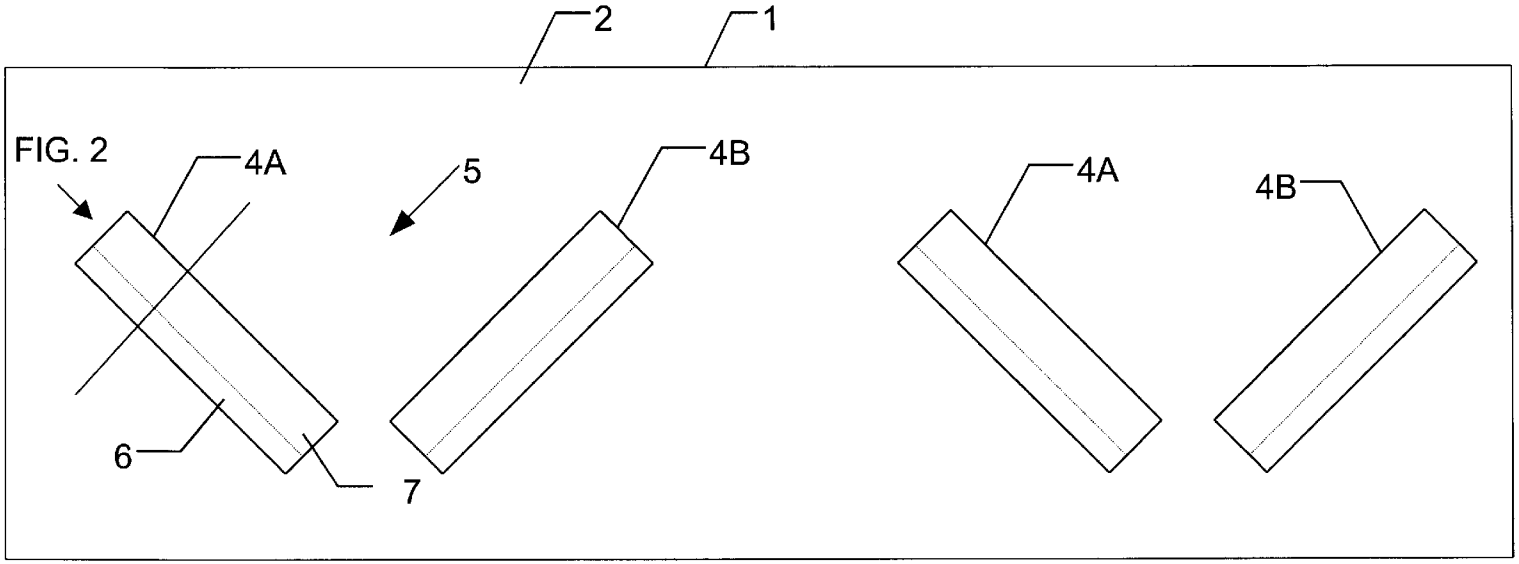
FIG. 1 is a view housing backplate, according to the present invention.

The present invention includes two parts: a bracket that is to be attached to a vertical surface, such as a wall, and mounting pads attached to the housing of the component or assembly to be mounted. A housing 1, according to the present invention, is shown in FIG. 1. Housing 1 includes a backplate 2 and contains the electrical or electronic components or assemblies that are to be mounted. Attached to backplate 2 is at least one mounting tab, such as mounting tab 4A.

Mounting tabs 4A–B are attached to backplate 2 and provide the mounting mechanism of the present invention. Two mounting tabs 4A–B are arranged in pairs in the form of a "V", with mounting tab 4B being a mirror image of mounting tab 4A. The included angle formed by the mounting tabs can theoretically have an included angle of from 0 to 180 degrees, but preferably, the included angle can be anywhere from 15 to 90 degrees. In one preferred embodiment, the included angle is approximately 60 degrees which allows a significant side-to-side misalignment during assembly. An embodiment is also contemplated in which the included angle is adjustable.

It can be seen that the provision of one or more of these "V" shaped mounting tab pairs adds a self-alignment feature that makes for an easier and faster installation. With this self-alignment comes an anti-rotational feature. It can be seen that to mount an assembly in the horizontal direction, the mounting tab pairs can be rotated 90 degrees (either way ) from that shown in FIG. 1.

Each mounting tab 4A–B includes a support member 6, which is attached to backplate 2, and a flange member 7. Housing 1 must include at least one pair of mounting tabs, but may include additional pairs of mounting tabs, depending upon the application. For example, additional pairs of mounting tabs may be used to support additional weight.

Figure 2:
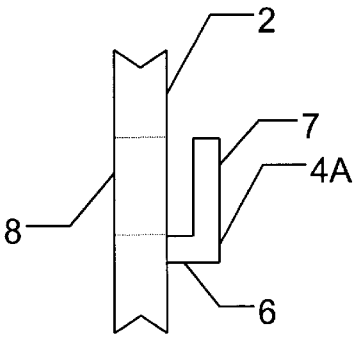
FIG. 2 is a cross-sectional view of a mounting tab attached to the backplate of FIG. 1.
Figure 3:
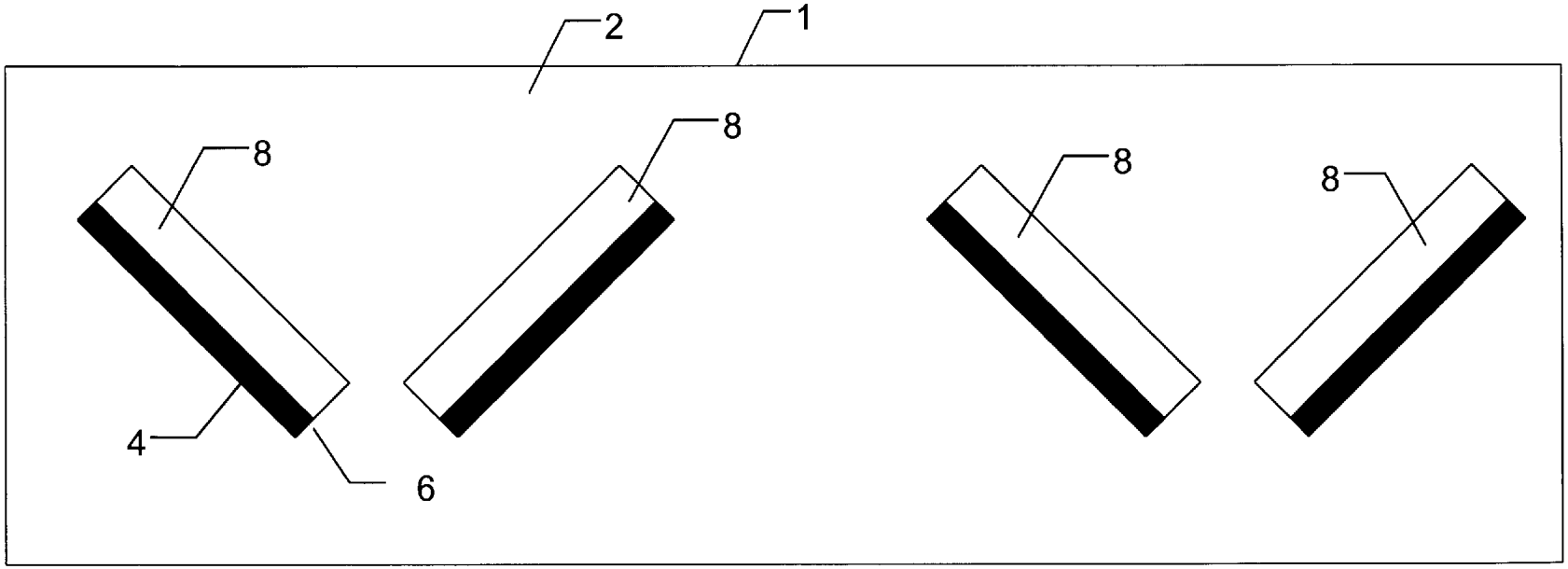
FIG. 3 is another cross-sectional view of a mounting tab attached to the backplate of FIG. 1.

A mounting tab 4A is shown in cross-section in FIG. 2. As shown, support member 6 is attached to backplate 2 and flange member 7 is attached to support member 6. Depending upon the construction technique that is used, the area 8 under flange member 6 may be open or solid. Open area 8 is shown more clearly in FIG. 3. Mounting tab 4B has a similar structure.

Figure 4:
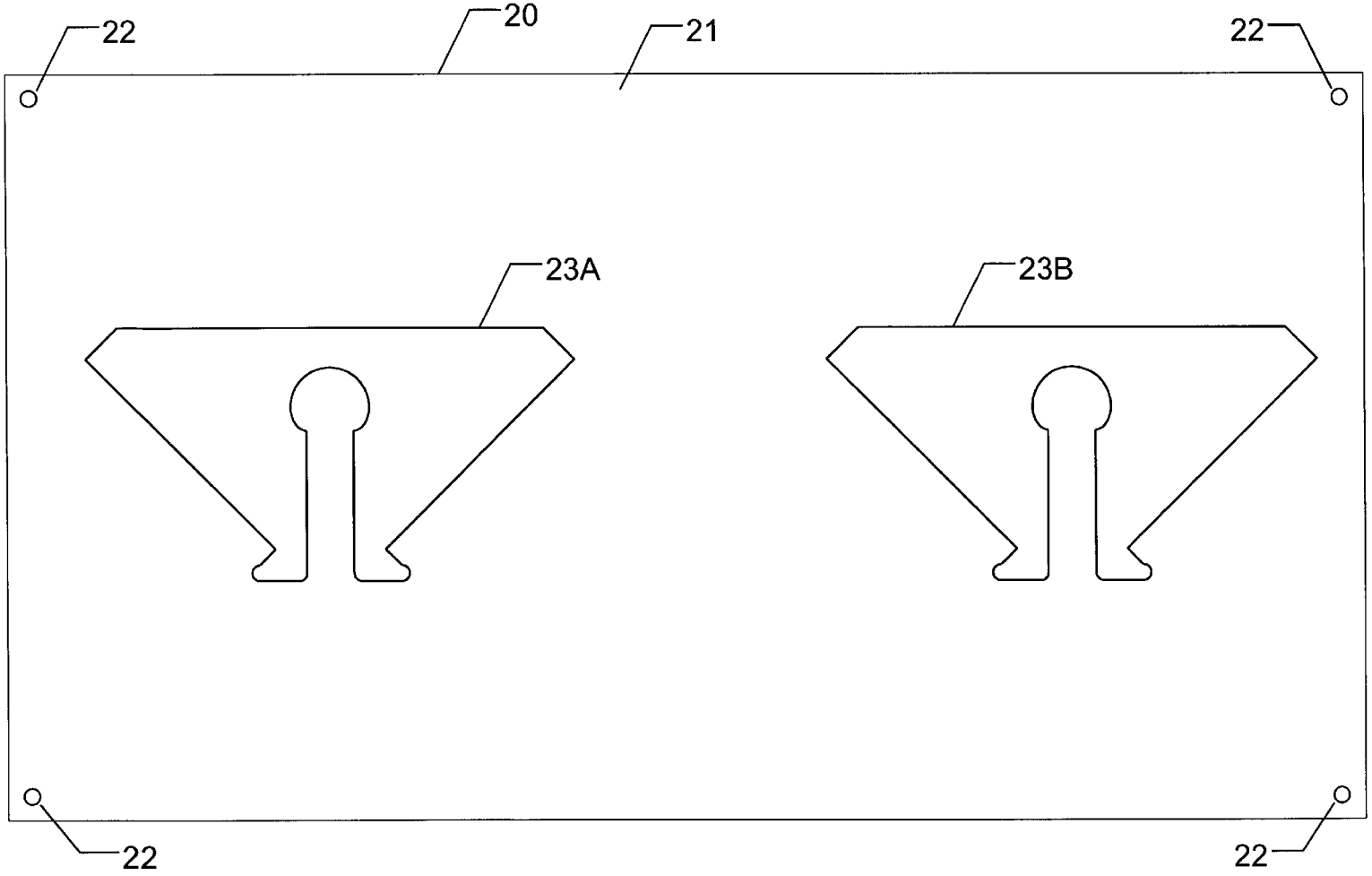
FIG. 4 is a view of a mounting bracket having mounting pads, according to one embodiment of the present invention, that mate with the mounting tabs of the backplate shown in FIG. 1.

The bracket 20 is shown in FIG. 4. Bracket 20 includes a baseplate 21, a plurality of mounting holes 22, and at least one mounting pad, such as pad 23A. Baseplate 21 is typically generally rectangular, but may instead be circular, oblong or other shapes. Baseplate 21 is typically flat, for mounting on a flat surface, such as a wall. If bracket 20 is to be mounted on an unflat or irregular surface, baseplate 21 may instead be shaped to match or accommodate the unflat or irregular surface. In addition, cutout areas may be provided along the edges or in the interior area of baseplate 21 to accommodate features of the surface to which the bracket is mounted, or to allow access by wiring, etc.

Mounting holes 22 are dispersed about baseplate 21 and allow the baseplate to be fastened to a vertical surface using fasteners, such as screws. Typically, mounting holes 22 are located near the corners of baseplate 21, but mounting holes may also be located along the edges or in the interior area of baseplate 21.

Figure 5:
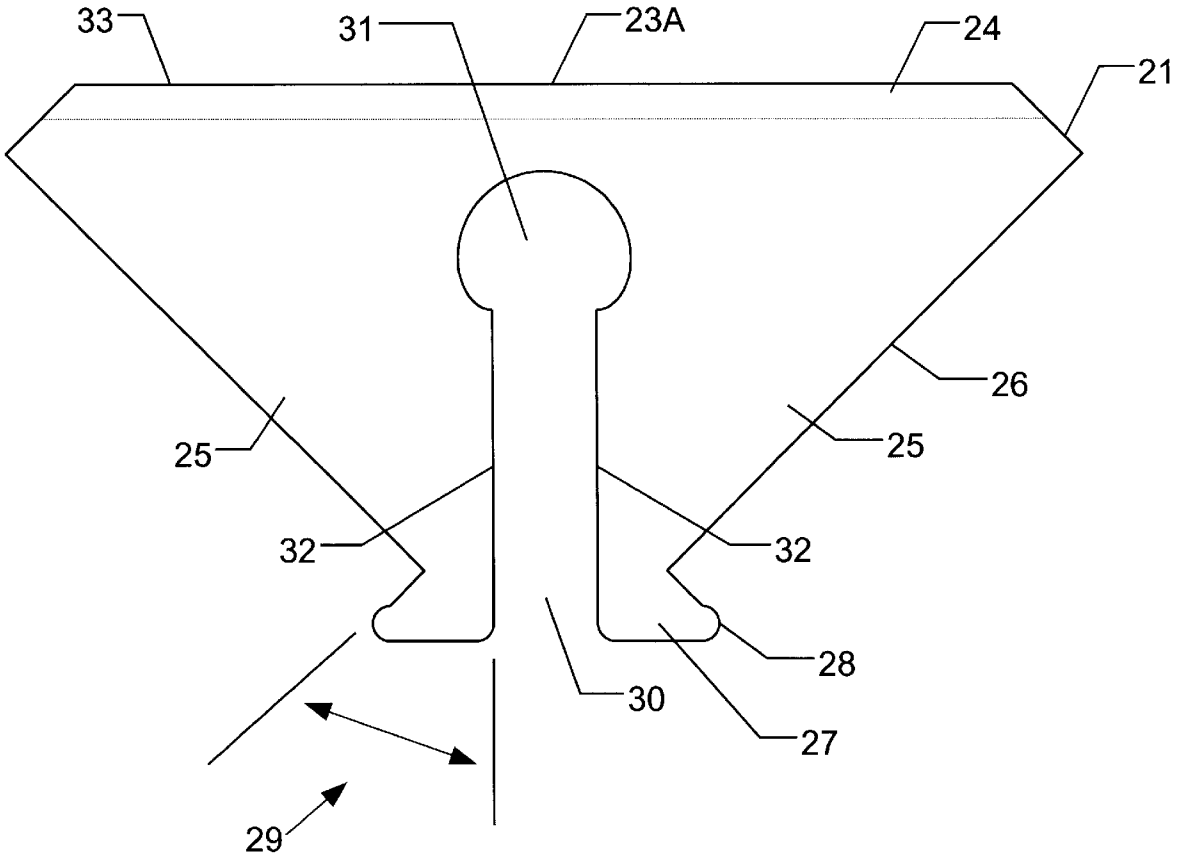
FIG. 5 is a more detailed view of a mounting pad shown in FIG. 4.

The structure of a mounting pad, such as pad 23A is shown in FIG. 5. Mounting pad 23A includes an attachment area 24 and at least one flexible locking finger 25. Face 26 abuts the inner surface of a mounting tab when the mounting pads are installed in the mounting tab. Installation force can be varied by increasing or decreasing the length of face 26. Locking tab 27 of locking finger 25 provides the positive locking mechanism of the present invention. Locking tab 27 includes radius 28 and angle 29. Installation force can be varied by increasing or decreasing radius 28 or angle 29 of locking tab 27.

Mounting pad 23A includes finger slot 30, which allows locking fingers 25 to flex. The installation force can be varied by increasing or decreasing the length of the finger slot 30. Finger slot 30 includes radius 31 and sides 32. The installation force can be varied by increasing or decreasing the radius 31 of finger slot 30. Sides 32 do not necessarily have to be parallel and can be angled to vary the installation force. Additional ways of varying the installation force include increasing or decreasing the width 33 of the mounting pad, or varying the thickness of the mounting pad. In addition, mounting installation force can be varied with the use of various materials (plastic, metal etc.) and combinations of same.

Figure 6:
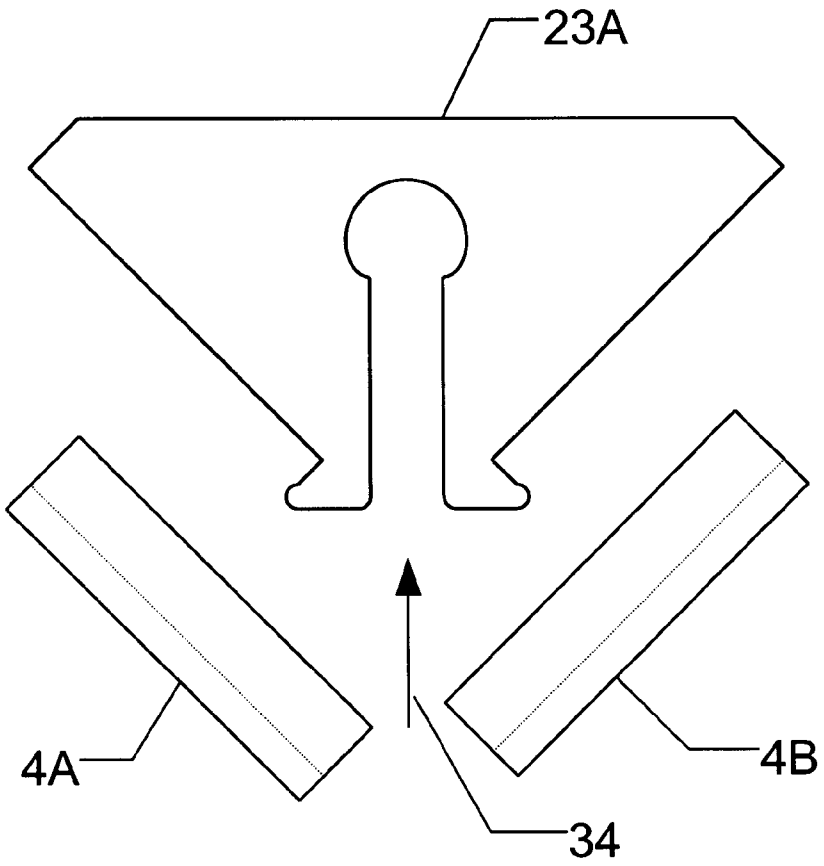
FIG. 6 shows an example of the initiation of the operation of one embodiment of the present invention.
Figure 7:
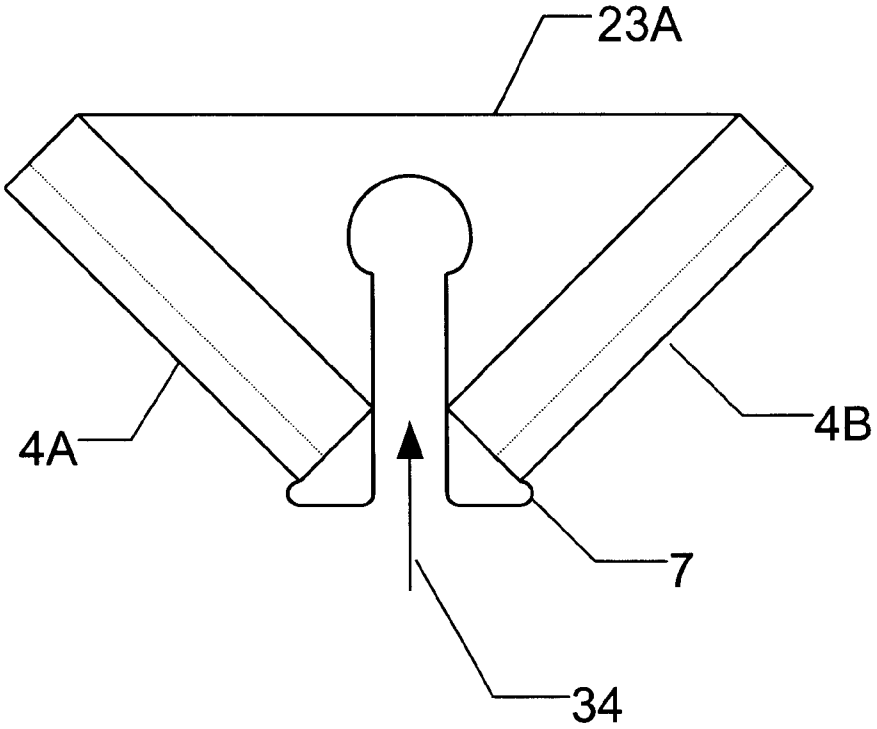
FIG. 7 shows an example of the completion of the operation of one embodiment of the present invention.

An example of the operation of the present invention is shown in FIGS. 6–7. The first step in mounting a component or assembly is shown in FIG. 6. The housing (not shown) of the component or assembly, which has attached to it mounting tabs 4A and 4B, is placed adjacent to the wall bracket (not shown). Mounting tabs 4A and 4B are, as a result, disposed adjacent to mounting pad 23A of the wall bracket. In the example shown in FIG. 6, mounting pad 23A is disposed between mounting tabs 4A and 4B. The housing is then moved vertically toward mounting pad 23A, as indicated by arrow 34. As shown in FIG. 6, the housing is moved until mounting tabs 4A and 4B engage and lock with mounting pad 23A, as shown in FIG. 7.

No horizontal movement of the housing is required to mount the housing to the wall bracket. Only vertical movement is needed. The vertical movement may be upwards, as shown in the example of FIGS. 6–7, or it may be downwards. Thus, the invention allows various component(s) or assembly installations to be placed in locations having little or no horizontal clearance.

The present invention includes a mechanical locking mechanism that makes the mounting assembly withstand vibration and is also a security lock. As shown in FIG. 7, when engaged, the locking tabs 7 of mounting pad 23A is engaged against mounting tabs 4A and 4B to provide the locking feature. The mechanical locking feature is anti-rotational and has a very low (minimal) height profile. It can be disassembled using a screwdriver or other similar implement.

Figure 8:
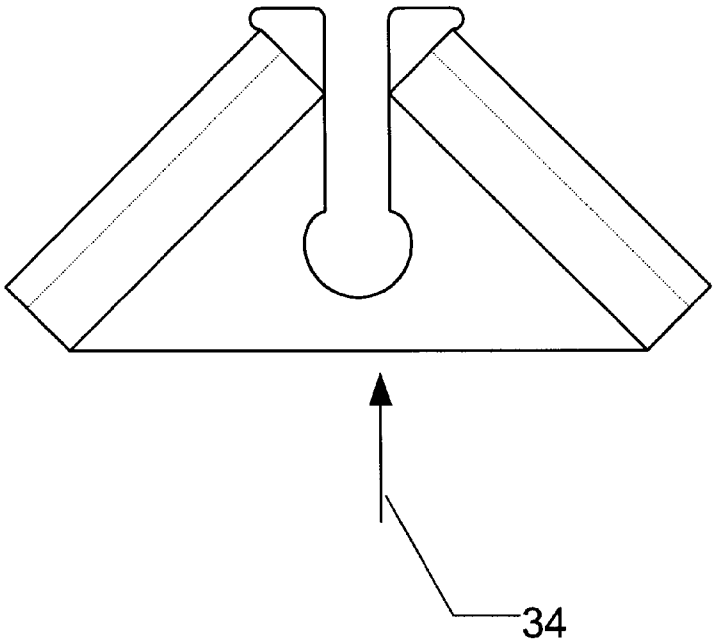
FIG. 8 shows another embodiment of the present invention.

Although, the example in FIGS. 6–7 is a horizontal application, it is seen that the present invention may be used at any mounting angle from 0 to 360 degrees, such as the 180 degree mounting angle, relative to vertical indicated by arrow 34, shown in FIG. 8, from this initial orientation and still withstand the weight of the assembly and vibration.

Figure 9:
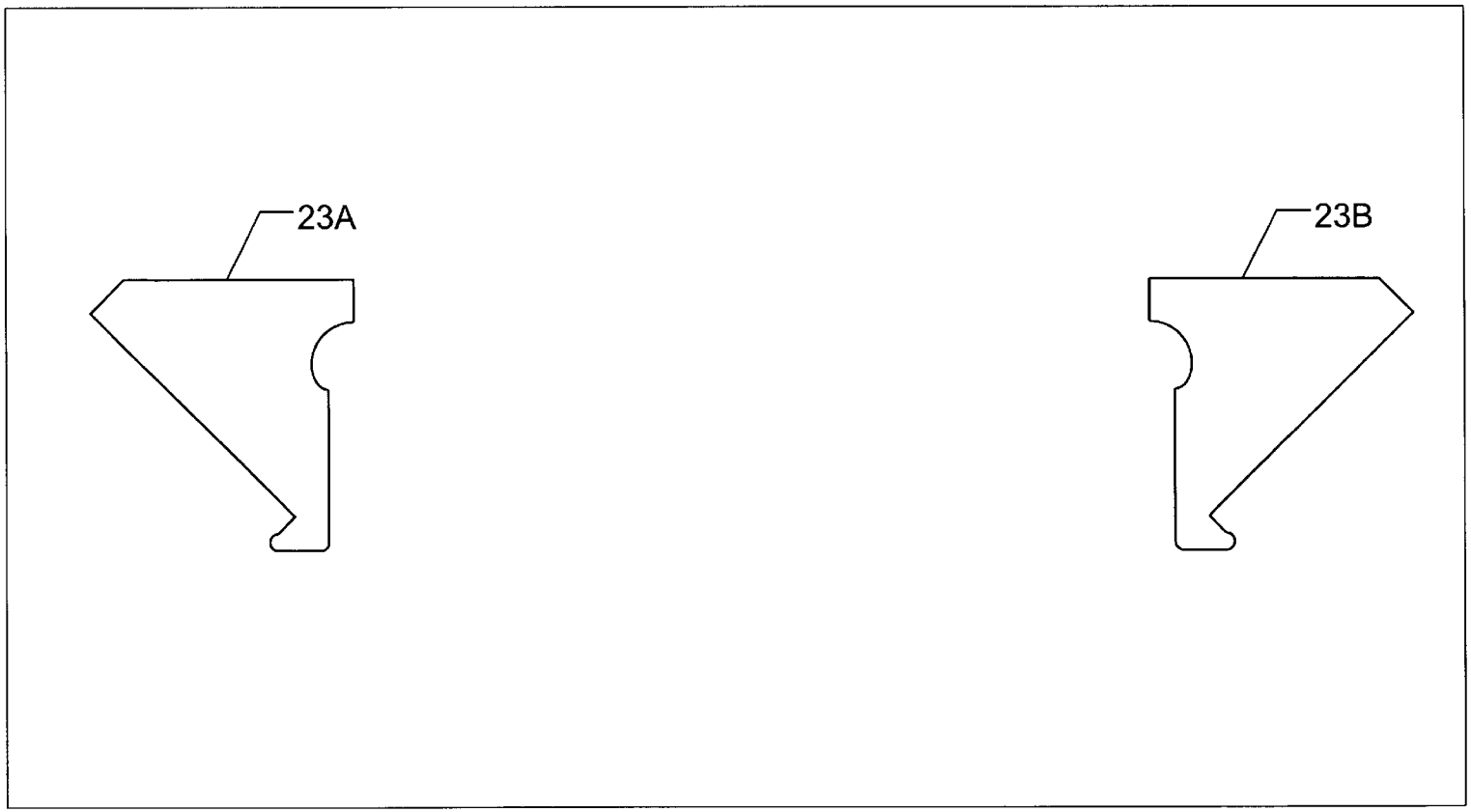
FIG. 9 shows another embodiment of the present invention.
Figure 10:
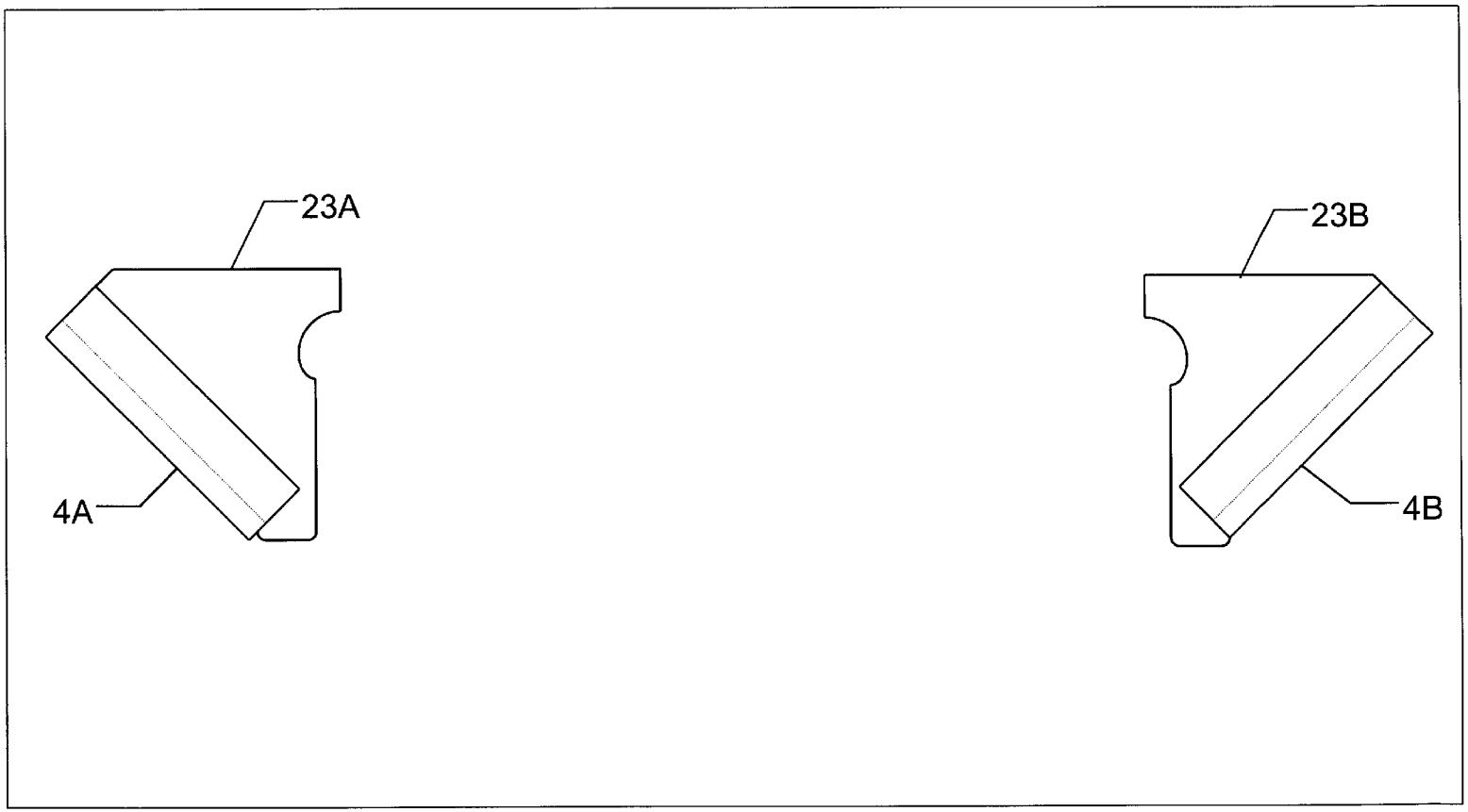
FIG. 10 shows the embodiment of FIG. 9 when engaged.

Another embodiment of the present invention is shown in FIG. 9. In this embodiment, there are two mounting pads 23A and 23B, but each mounting pad has only one finger 25. The mounting pads are arranged so that they mirror each other and so that the fingers are disposed away from each other. Mounting pads 23A and 23B engage with one pair of mounting tabs 4A and 4B, as shown in FIG. 10. Mounting tabs 4A and 4B are spaced apart from each other a distance sufficient to stably support the component housing.

Figure 11:
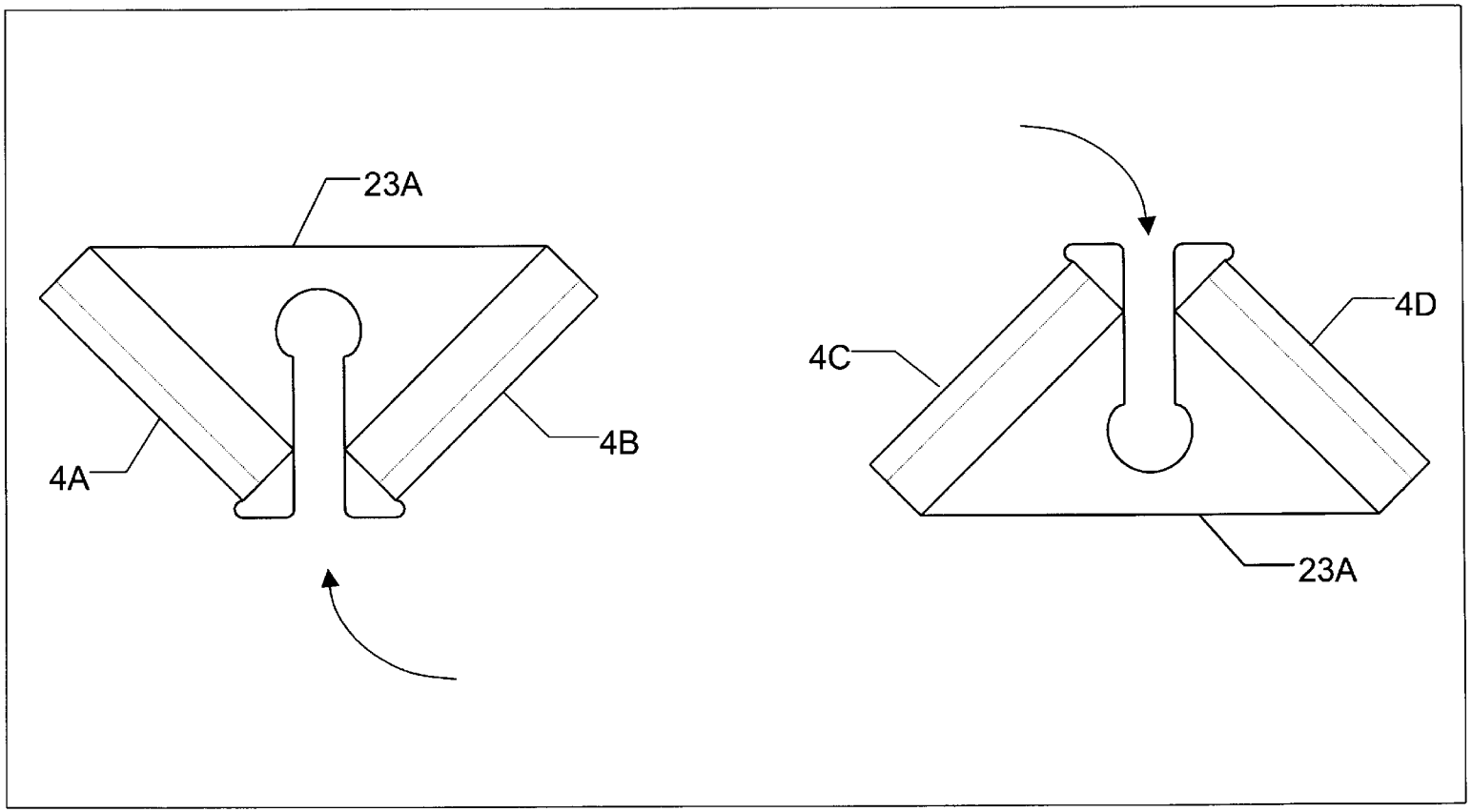
FIG. 11 shows another embodiment of the present invention.

Another embodiment of the present invention is shown in FIG. 11. In this embodiment, there are two mounting pads 23A and 23B, but the mounting pads and mounting tabs are disposed approximately 180 degrees from each other. For example, mounting pad 23B and corresponding mounting tabs 4C and 4D have been rotated 180 degrees from mounting pad 23A and corresponding mounting tabs 4A and 4B. The component housing is then installed with a twisting motion, as shown by the arrows.

It will also be seen that in an alternative embodiment, the mounting pads and mounting tabs may be interchanged between the wall and the housing. In particular, the mounting pads may be disposed on the backplate of the housing and the mounting tabs may be disposed on the bracket.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. An apparatus for mounting a component, the component having a housing, the apparatus comprising:

a backplate adapted for attachment to the housing;

a mounting tab disposed on the backplate, the mounting tab comprising:

a first support member attached to the backplate and a first flange member attached to the first support member, a second support member attached to the backplate and a second flange member attached to the second support member, wherein the first and second support members are arranged so as to form an included angle between an inner surface of the first support member and an inner surface of the second support member; and a bracket comprising:

a baseplate defining a plane, and a mounting pad disposed on the baseplate in the plane, the mounting pad including an attachment area, attached to the baseplate, a first finger integral with the attachment area and having a first face, and a second finger integral with the attachment area and having a second face, the first finger and the second finger projecting in the plane and articulable in the plane, the first face of the first finger and the second face of the second finger are defined in the same plane, whereby the mounting pad may be disposed in a region between the support members of the mounting tab and between the flange members of the mounting tab and the backplate so that the first finger is disposed between the first support member and the backplate, the first face of the first finger abuts the inner surface of the first flange member, the second finger is disposed between the second support member and the backplate, and the second face of the second finger abuts the inner surface of the second flange member.

2. The apparatus of claim 1, wherein each finger of the mounting pad includes a locking tab that engages with a support member of a different mounting tab.

3. The apparatus of claim 2, wherein a plurality of pairs of mounting tabs are disposed on the backplate and a plurality of mounting pads are disposed on the baseplate.

4. The apparatus of claim 2, wherein two pairs of mounting tabs, a first pair and a second pair, are disposed on the backplate and two mounting pads, a first mounting pad and a second mounting pad, are disposed on the baseplate, and wherein the first pair of mounting tabs is disposed approximately 180 degrees from the second pair of mounting tabs, and the first mounting pad is disposed approximately 180 degrees from the second mounting pad.

5. The apparatus of claim 2, wherein the mounting pads are plastic.

6. The apparatus of claim 2, wherein the mounting pads are metal.

7. An apparatus for mounting a component having a housing, the apparatus comprising:

a backplate adapted for attachment to the housing;

first mounting tab disposed on the backplate, the first mounting tab including a first support member attached to the backplate and a first flange member attached to the first support member;

a second mounting tab disposed on the backplate, the second mounting tab including a second support member attached to the backplate and a second flange member attached to the second support member;

wherein, the first mounting tab and the second mounting tab are arranged so that the first flange member is disposed towards the second flange member; and a bracket comprising:

a baseplate defining a plane, a first mounting pad disposed on the baseplate in the plane, the first mounting pad including a first attachment area, attached to the baseplate, and a first finger integral with the first attachment area, the first finger projecting in the plane and articulable in the plane, the first flange having a first face;

a second mounting pad disposed on the baseplate in the plane, the second mounting pad including a second attachment area, attached to the baseplate, and a second finger integral with the second attachment area, the second finger projecting in the plane and articulable in the plane, the second flange having a second face, the first face and the second face are defined in the same plane;

whereby the first mounting pad and the second mounting pad may be disposed in a region between the first support member of the first mounting tab and the second support member of the second mounting tab, wherein the first finger of the first mounting pad is disposed between the first support member of the first mounting tab and the backplate, the first face of the first finger abuts the inner surface of the first flange member and the second finger of the second mounting pad is disposed between the second support member of the second mounting tab and the backplate, and the second face of the second finger abuts the inner surface of the second flange member.

8. The apparatus of claim 7, wherein the first and second mounting tabs are further arranged so as to form an included angle between an inner surface of the first support member and an inner surface of the second support member and wherein the first finger of the first mounting pad may be disposed between the first flange member of the first mounting tab and the backplate so as to abut the inner surface of the first support member and the second finger of the second mounting pad may be disposed between the second flange member of the second mounting tab and the backplate so as to abut the inner surface of the second support member.

9. The apparatus of claim 8, wherein the first finger of the first mounting pad includes a first locking tab that engages with the first support member of the first mounting tab and the second finger of the second mounting pad includes a second locking tab that engages with the second support member of the second mounting tab.

10. The apparatus of claim 9, wherein the mounting pads are plastic.

11. The apparatus of claim 9, wherein the mounting pads are metal.

12. The apparatus of claim 7, wherein the second mounting tab is further arranged so as to be disposed approximately 180 degrees from the first mounting tab and the second mounting pad is further arranged so as to be disposed approximately 180 degrees from the first mounting pad.

13. The apparatus of claim 12, wherein the first finger of the first mounting pad includes a first locking tab that engages with the first support member of the first mounting tab and the second finger of the second mounting pad includes a second locking tab that engages with the second support member of the second mounting tab.

14. The apparatus of claim 13, wherein the mounting pads are plastic.

15. The apparatus of claim 13, wherein the mounting pads are metal.

* * * * *